US008727154B2

(12) United States Patent
Oguchi et al.

(10) Patent No.: US 8,727,154 B2
(45) Date of Patent: May 20, 2014

(54) SYNTHETIC RESIN BOTTLE

(75) Inventors: Hiroki Oguchi, Tokyo (JP); Shigeru Tomiyama, Tokyo (JP); Takao Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 406 days.

(21) Appl. No.: 11/920,696

(22) PCT Filed: Jun. 15, 2006

(86) PCT No.: PCT/JP2006/311979

§ 371 (c)(1),
(2), (4) Date: Nov. 19, 2007

(87) PCT Pub. No.: WO2007/004398

PCT Pub. Date: Jan. 11, 2007

(65) Prior Publication Data

US 2009/0321385 A1 Dec. 31, 2009

(30) Foreign Application Priority Data

Jun. 30, 2005 (JP) ..... 2005-193158

(51) Int. Cl.
*B65D 1/02* (2006.01)

(52) U.S. Cl.
USPC ..... 215/384; 215/383; 215/382; 215/379; 215/381; D9/516; D9/667; D9/560

(58) Field of Classification Search
USPC ..... 215/384, 383, 382, 379, 381; D9/516, D9/667, 560
See application file for complete search history.

(56) References Cited

U.S. PATENT DOCUMENTS

| | | | | | |
|---|---|---|---|---|---|
| 3,536,500 | A * | 10/1970 | Cleereman et al. | ..... | 426/130 |
| 5,199,588 | A * | 4/1993 | Hayashi | ..... | 215/381 |
| 5,381,910 | A * | 1/1995 | Sugiura et al. | ..... | 215/398 |
| 7,114,626 | B2 * | 10/2006 | Tanaka et al. | ..... | 215/382 |
| 7,165,693 | B2 * | 1/2007 | Oguchi et al. | ..... | 215/381 |

(Continued)

FOREIGN PATENT DOCUMENTS

| | | | |
|---|---|---|---|
| JP | 2003104347 | A * | 4/2003 |
| JP | A-2003-104347 | | 4/2003 |
| JP | A-2004-250063 | | 9/2004 |
| JP | A-2004-292039 | | 10/2004 |

*Primary Examiner* — Fenn Mathew
*Assistant Examiner* — Cynthia Collado
(74) *Attorney, Agent, or Firm* — Oliff PLC

(57) ABSTRACT

The technical problem to be solved by this invention is to design bottle walls having such a shape as to inhibit cave-in deformation into a dented wall shape caused by recessed areas for fingerhold. The object of this invention is to provide a synthetic resin square bottle which is usable without anxiety, is excellent at firm hold, and has a high vacuum-absorbing function.

In a synthetic resin square bottle comprising a body formed by multiple panel walls disposed on the body in a circumferential direction, and a waist portion made of a peripheral groove dented at a roughly middle height position of the body so as to divide each panel wall into an upper panel and a lower panel, recessed areas for fingerhold use are formed in at least a pair of opposing panel walls in a certain area ranging from the waist portion to an upper end portion of the lower panel of each panel wall, and a pair of side ribs is formed on right and left sides of, and in the vicinity of, each recessed area in the lower panel.

9 Claims, 5 Drawing Sheets

(56) References Cited

U.S. PATENT DOCUMENTS

| | | | | |
|---|---|---|---|---|
| D562,686 | S * | 2/2008 | Fukuda | D9/516 |
| 7,552,833 | B2 * | 6/2009 | Tsutsui et al. | 215/381 |
| 7,712,620 | B2 * | 5/2010 | Nemoto et al. | 215/384 |
| 2001/0035392 | A1 * | 11/2001 | Ota et al. | 215/381 |
| 2001/0054597 | A1 * | 12/2001 | Ozawa et al. | 215/381 |
| 2004/0022976 | A1 * | 2/2004 | Kato et al. | 428/35.7 |
| 2009/0289028 | A1 * | 11/2009 | Sasaki et al. | 215/384 |

* cited by examiner (a)

(b)

SYNTHETIC RESIN BOTTLE

TECHNICAL FIELD

This invention relates to a square synthetic resin bottle having recessed areas for fingerhold use formed in certain portions of the body.

Synthetic resin bottles made of a polyethylene terephthalate resin (hereinafter referred to as the PET resin) and the like are in wide use as the containers for drinks and foods. Such bottles of a size as large as 2 L in capacity are provided with a handle for secure grip with a hand or are provided with a waist portion that makes it easy to hold the body of a bottle. Addition of a handle to a bottle requires a higher cost of production. A waist portion without fingerhold has a problem in that the bottle is slippery to hold. In this point, Patent Document 1 describes a round bottle having multiple recesses for fingerhold in the body wall. It is asserted in this document that the bottle can be grabbed firmly and can be manufactured at a low cost.

[Patent Document 1] Published patent application JP2004-1847 A

DISCLOSURE OF THE INVENTION

Technical Problems to be Solved by the Invention

However, in the case of the so-called square bottles having multiple panel walls disposed in parallel in the circumferential direction, the user holds the bottle with a hand by placing the thumb and fingers in the recesses. In that position of hold, parts of the bottle wall in the vicinity of recesses may cave in and deform. Such deformation not only gives damage to the appearance, but also it is problematic because the contents may burst out when the user is pouring out the contents.

In the applications in which bottles are filled with contents at a high temperature for sterilization and are sealed with a cap, there are many cases where the bottles are provided with vacuum-absorbing panels which deform to absorb inconspicuously a decrease in volume caused by pressure drop (sometimes also referred to as a vacuum-absorbing function). Thus, even in a bottle provided with vacuum-absorbing panels, there occurs a problem in which the recesses for fingerhold give rise to the progress in cave-in deformation as panel surfaces are partly turned in a reverse direction. And these problems will become remarkable if the body wall is thinned to reduce the material cost, or if large recessed areas are used for the convenience of easy fingerhold.

These problems of square bottles are likely to become more conspicuous than in the case of round bottles because square bottles have flat panel walls. On the other hand, in the round bottles such as described in Patent Document 1, the entire body wall intrinsically has an outward curve. As such, the round bottles have full plane rigidity against the force coming from outside, under a depressurized condition or when the user grabs the bottle so as to squeeze the body by placing the thumb and fingers of a hand in the recesses for fingerhold.

This invention has been made to solve the above-described problems found in the square bottles. The technical problem to be solved by this invention is to design bottle walls having such a shape as to inhibit cave-in deformation into a dented wall shape caused by the recessed areas for fingerhold. The object of this invention is to provide a synthetic resin square bottle which is usable without anxiety, is excellent at firm hold, and has a high vacuum-absorbing function.

The means of carrying out the invention of claim 1 to solve the above-described problems is a synthetic resin square bottle comprising a body formed by multiple panel walls disposed in parallel to one another in a circumferential direction, and a waist portion made of a peripheral groove dented at a roughly middle height position of the body so as to divide each panel wall into an upper panel and a lower panel, wherein said bottle is characterized in that recessed areas for fingerhold use are formed in at least a pair of opposing panel walls in certain areas ranging from the waist portion to an upper end portion of the lower panel of each panel wall and that a pair of side ribs is formed on right and left sides of, and in the vicinity of, each recessed area in the lower panel, and wherein the recessed areas are positioned at a central position in the lateral width of each panel wall and the recessed areas are designed by a waist recess formed by making the waist portion deeper and a panel recess in the form of a gentle slope from the panel wall surface to the lower end of the waist recess.

The waist portion is often formed especially in the case of the bottles of a large size for the purpose of securing rigidity of bottles. The above-described configuration of claim 1 involves forming recessed areas for fingerhold by utilizing parts of the waist portion in the shape of a peripheral groove. All the panel walls are disposed in parallel to one another in the circumferential direction, and each panel wall is divided into two parts by the waist portion. An upper panel is disposed above the waist portion, and a lower panel is disposed beneath the waist portion.

Under the above-described configuration of claim 1, each recessed area is formed as a certain expanded area ranging from the waist portion to the upper end portion of the lower panel. The recessed area portion formed in the lower panel is used as a guide to lead the thumb and fingers into the waist portion for firm grip and to ensure that the thumb and fingers can be hooked by the upper side of the waist portion having the shape of a peripheral groove. In this way, the bottle can be held firmly.

Each recessed area is an expanded area including the upper end portion of the lower panel. In this state, the entire thumb and fingers can be placed in the recesses so that the user can hold the bottle firmly. If necessary, the recessed area can be further widened from the waist portion into the upper panel.

In the meantime, a pair of side ribs is formed on the right and left sides of each recessed area in the lower panel. These side ribs increase the plane rigidity in this portion of the panel wall, and prevent cave-in deformation into a reversed state from occurring in the portions of the panels when the user puts the thumb and fingers into recessed areas to hold the bottle or when the depressurized condition gets under way inside the bottle.

If each recessed area extended to a wide area including the upper end of the lower panel, this recessed area would give rise to cave-in deformation into a reversed state in the area near the lower panel where the surface is flat. A pair of side ribs disposed on both sides of, and in the vicinity of, the recessed area in the lower panel should be able to prevent effectively this cave-in deformation from occurring.

The means of carrying out the invention of claim 2 comprises that, in the invention of claim 1, an underside rib is formed directly beneath the recessed area in each lower panel.

Under this configuration of claim 2, an underside rib is formed directly beneath the recessed area, in addition to the side ribs on both sides of the recessed area. Thus, the recessed area portion in the lower panel is enclosed by the underside rib, the side ribs, and the groove-like waist portion. Therefore, the cave-in deformation, which may occur in the area near each lower panel as caused by the recessed areas, can be controlled by this enclosure. Especially the cave-in deformation into a reversed state, which may occur in the lower panel, can be more effectively controlled.

The means of carrying out the invention of claim 3 comprises that, in the invention of claim 1 or 2, the body comprises four panel walls and four chamfered corner walls that connect every two adjacent panel walls, and that the body has a cross-section in a rectangular shape.

Under the above-described configuration of claim 3, there can be provided a square bottle having a rectangular cross-section, which is usable without anxiety, is excellent at firm hold, and has a high vacuum-absorbing function. The square bottles of claim 3 especially having a 2 L capacity are being manufactured on a massive scale. These bottles are easy to hold firmly, and can be provided while keeping the cost at a low level.

Effects of the Invention

This invention having the above-described construction has the following effects:

In the invention of claim 1, the recessed area portion in the respective lower panels are utilized as the guide to lead the thumb and fingers smoothly into the waist portion for firm grip so that the user can hold the bottle firmly. A pair of side ribs formed on both sides of, and in the vicinity of, each recessed area can effectively inhibit the cave-in deformation of the lower panel into a reversed state caused by the panel recess.

In the invention of claim 2, the recessed area portion in the lower panel is enclosed by the groove-like waist portion, a pair of side ribs, and the underside rib. Because of this enclosure, it is possible to inhibit the action of the recessed area which gives rise to cave-in deformation and therefore to effectively control the cave-in deformation into a reversed state, which may occur in the area near each lower panel.

Square bottles with a size as large as a 2 L capacity and having a rectangular cross-section, especially made of a PET resin, are being manufactured on a massive scale. In the invention of claim 3, these bottles with easy and firm fingerhold can be provided while keeping the cost at a low level.

BRIEF DESCRIPTION OF THE DRAWINGS

FIG. 5(*b*) is a partially enlarged view of the area R2 in FIG. 5(*a*).

EXPLANATION OF CODES

Figure 1:
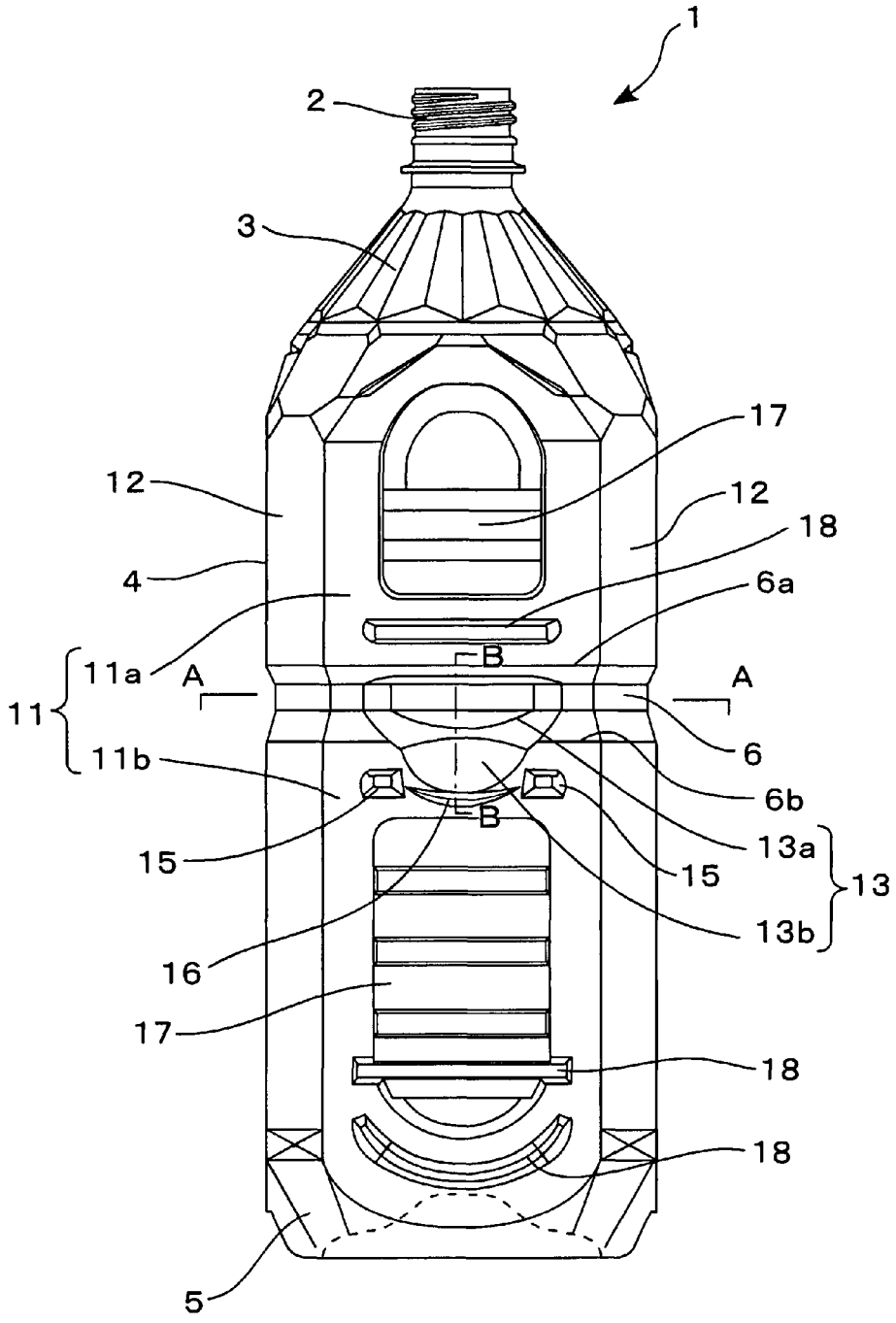
FIG. 1 is a front elevational view of the bottle in the first embodiment of this invention.

1. Bottle
2. Neck
3. Shoulder
4. Body
5. Bottom
6. Waist portion
6*a*. Upper side (of the waist portion)
6*b*. Lower side (of the waist portion)
11. Panel wall
11*a*. Upper panel
11*b*. Lower panel
12. Corner wall
13. Recessed area
13*a*. Waist recess
13*b*. Panel recess
15. Side rib
16. Underside rib
17. Vacuum-absorbing panel
18. Reinforcing rib
R1, R2. Area
S. Area
T1, T2, T3. Characteristic curve

PREFERRED EMBODIMENTS OF THE INVENTION

Figure 2:
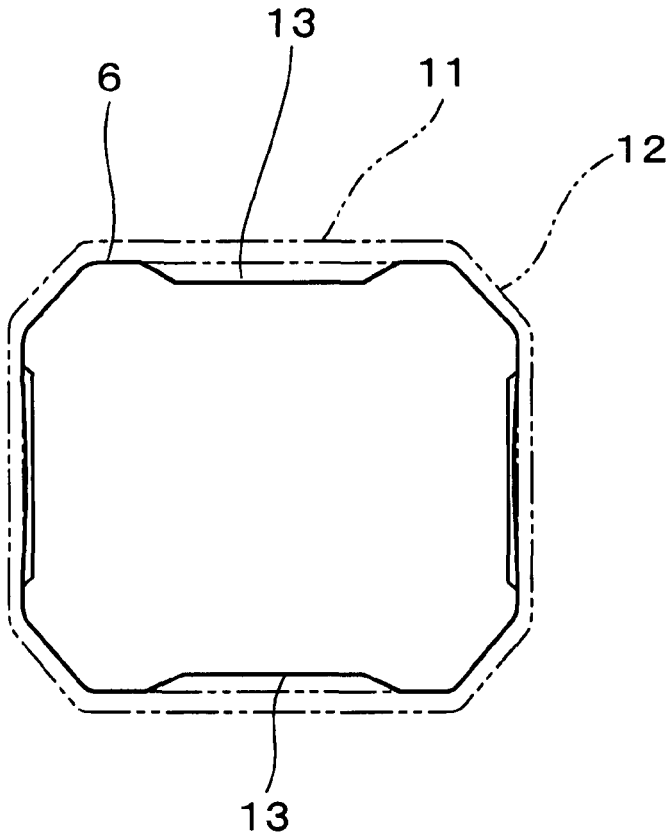
FIG. 2 is a cross-sectional plan view of the bottle taken from line A-A in FIG. 1.
Figure 3:
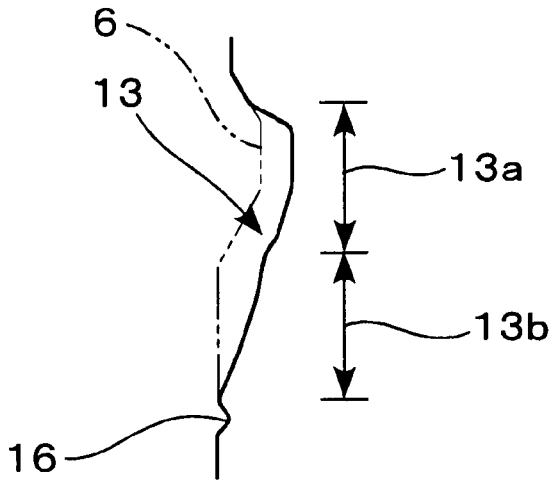
FIG. 3 is a vertical section of a recessed area taken from line B-B in FIG. 1.

This invention is further described with respect to preferred embodiments, now referring to the drawings. FIGS. 1-3 show the synthetic resin bottle in the first embodiment of this invention. FIG. 1 is a front elevational view of the bottle. FIG. 2 is a cross-sectional plan view taken from line A-A in FIG. 1. FIG. 3 is a vertical section taken from line B-B, which shows the contour of a later-described recessed area 13

This bottle is a biaxially drawn, blow molded product made of a PET resin, and is a square bottle having a neck 2, a shoulder 3, a body 4, and a bottom 5, and has a nominal capacity of 2 L. The body 4 is formed by four panel walls 11 and four chamfered corner walls 12 which connect every two adjacent panel walls 11. As shown in FIG. 2, the bottle has a cross-section in the shape of a rectangle.

A waist portion 6 in the shape of a peripheral groove is formed at a roughly middle height position of the body 4 to increase the rigidity of the bottle 1. A panel wall 11 is divided by this waist portion 6 into an upper panel 11*a* and a lower panel 11*b*. A recessed area 13 for the fingerhold use is formed in the area ranging from the waist portion 6 to upper end portion of the lower panel 11*b* and at a central position in the lateral width of each broad panel wall 11. Such a panel wall 11 corresponds to either one of a pair of long sides in a rectangular cross-sectional view, and the pair of these panel walls 11 is disposed in a face-to-face relationship with central axis in-between.

This recessed area 13 has a waist recess 13*a* and a panel recess 13*b*, as shown in the vertical section of FIG. 3. The waist recess 13*a* is formed by making the waist portion further deeper. The panel recess 13*b* is formed in the upper end portion of the lower panel 11*b* by giving a gentle slope from the panel wall surface to the lower end of the waist recess 13*a*.

A pair of dented side ribs 15 having a roughly square shape is disposed on both sides of, and in the vicinity of, the panel recess 13*b* which is formed in a semicircular shape. In addition, an underside rib 16 of a transverse groove in an arched shape is disposed directly beneath the panel recess 13*b*. As will be described later, these ribs lend themselves to prevent cave-in deformation that may occur in the vicinity of the panel recess 13*b* of the lower panel 11*b*.

The upper and lower panels 11*a*, 11*b* are also provided with a vacuum-absorbing panel 17 and a reinforcing rib 18 in the shape of a transverse groove so as to increase the rigidity of the bottle.

Figure 4:
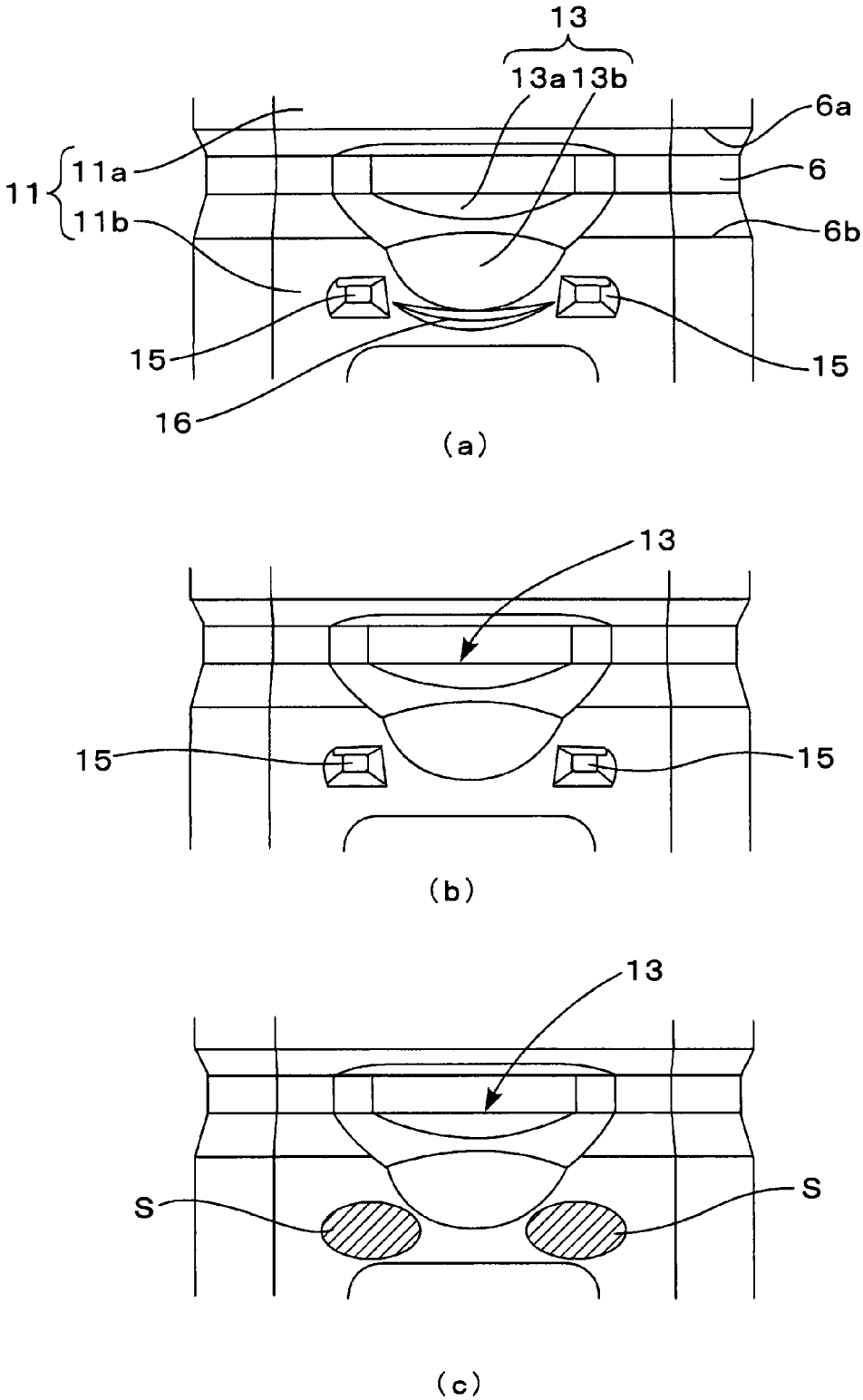
FIG. 4(*a*), FIG. 4(*b*), and FIG. 4(*c*) are partially enlarged view of a recessed area and its surroundings, respectively, of the bottle in the first embodiment, the bottle in the second embodiment, and the bottle in a comparative example.

FIG. 4 are partially enlarged front elevational views of a recessed area and its vicinity. FIG. 4(*a*) shows the recessed area of the bottle in the first embodiment of this invention, in which the bottle is provided with side ribs 15 and an underside rib 16. FIG. 4(*b*) shows a counterpart in the second embodiment of this invention, in which only side ribs 15 are disposed. FIG. 4(*c*) is a recessed area in a comparable example in which the bottle has no rib. Depressurization tests were conducted with these three types of bottles to confirm the action and effect of the side ribs 15 and the underside rib 16.

Figure 5:
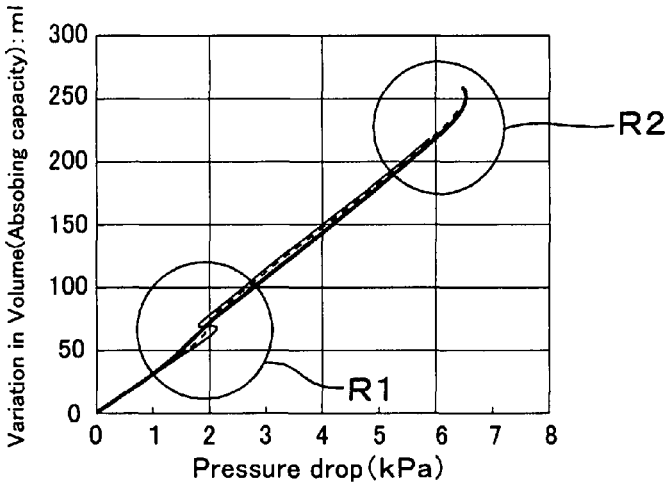
FIG. 5(*a*) is an entire graph showing the results of vacuum-absorbing tests with 3 types of bottles.
Figure 5:
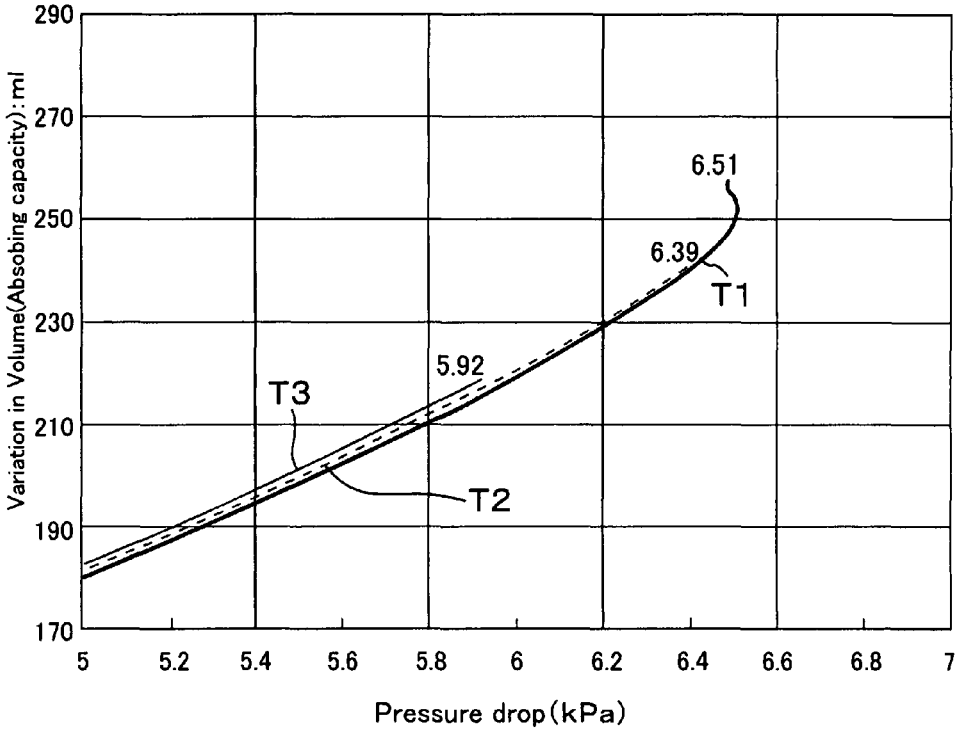
Figure 6:
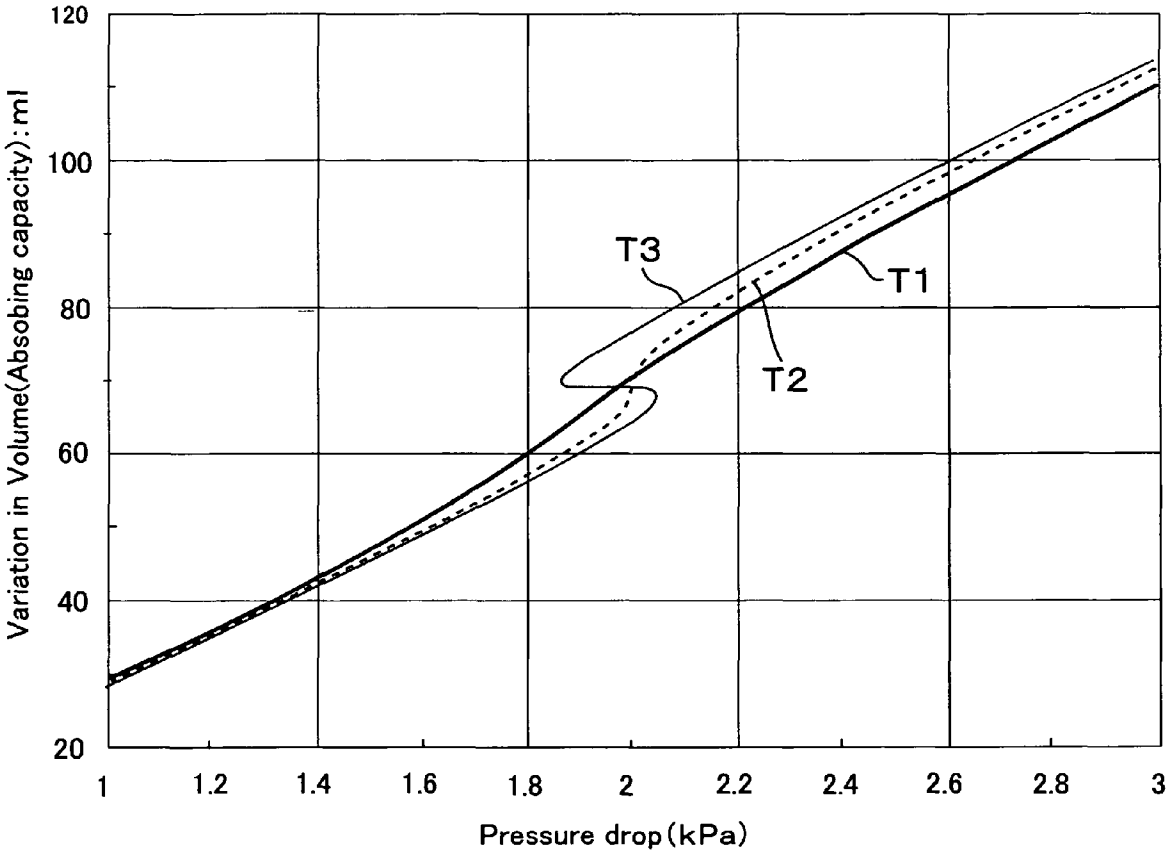
FIG. 6 is a partially enlarged view of the area R1 in FIG. 5(*a*).

FIGS. 5 and 6 are graphs showing characteristic curves of the level of pressure drop vs. variation in volume (or absorbing capacity). T1 in the graphs is the characteristic curve for the bottle in the first embodiment of this invention; T2, for the bottle in the second embodiment; and T3, for the bottle in the comparative example. FIG. 5(*a*) is an overall view of the graph showing characteristic curves. FIG. 5(*b*) is a partially enlarged graph showing the area of R2 which is circled in FIG. 5(*a*). FIG. 6 is a partially enlarged graph showing the area of R1 which is also circled in FIG. 5(*a*). In the Figures, the level of pressure drop on the lateral axis are obtained as the values of (outside barometric pressure−pressure inside the bottle). The variations in volume are obtained as the values of (V0−V) where V0 is the volume at the time when the level of pressure drop is zero; and V is a volume at a certain level of pressure drop. The variation in volume is referred to as "absorbing capacity" in the following description.

As obvious from the overall view of FIG. 5(*a*), the absorbing capacity increases linearly with gradual rise in the level of pressure drop, starting from 0 kPa. But there is a point of inflection near 2 kPa. When the level of pressure drop is further brought to higher levels, there occurred large cave-in deformation into a reversed state at or near a pressure drop level of about 6 kPa. The tests were terminated at this point. The level of pressure drop at this point of termination is used as an indication for the vacuum-absorbing function of a bottle because this level indicates what level of pressure drop can be applied to a bottle. This level was 6.51 kPa for the bottle in the first embodiment of this invention, 6.39 kPa for the bottle in the second embodiment, and 5.92 kPa for the bottle in the comparable example (See FIG. 5(*b*)).

FIG. 6 is a partially enlarged graph showing the area of R1 in FIG. 5(*a*), where the point of inflection was observed. In the characteristic curve T3 for the comparative example, the level of pressure drop shows large reversing behavior near 2 kPa. This occurred because panel surface of the lower panel 11*b* was reversed and dented because of the cave-in deformation which took place in a moment of time in the areas S indicated by hatched circles in FIG. 4(*c*). Such deformation occurred because a recessed area 13, or more specifically a panel recess 13*b*, was formed.

On the other hand, the characteristic curve T1 for the bottle in the first embodiment trended almost linearly and rose ever-increasingly, giving no deformation in appearance. The bottle in the second embodiment was tested to see whether the pair of side ribs is effective or not. Although its characteristic curve T2 showed a shallow sigmoid change, only a slight dent of the panel wall was observed in the area surrounding the side ribs 15, and there was no cave-in deformation into the reversed state, such as found in the comparative example. This minor change had no problem for practical purposes.

Results of the tests with the bottle in the second embodiment of this invention and the bottle in the comparative example proved that the side ribs 15 thus formed can protect the bottle against cave-in deformation into the reversed state, which otherwise would take place at or near a pressure drop level of 2 kPa, as caused by forming a wide recessed area 13 including the upper end portion of the lower panel 11*b*. Furthermore, results of the tests with the bottles in the first and second embodiments proved that additional use of an underside rib 16 ensures more reliable control of the cave-in deformation in the area surrounding each recessed area 13.

In addition, the configuration of these side rib 15 and underside rib 16 could increase the final absorbing capacity under a pressure drop condition.

Fingerhold strength was tested by placing the thumb and fingers of a hand into the recessed areas 13. The deformation behavior in and around the recessed areas 13 caused by the pressure force from the thumb and fingers of the bottle-holding hand well corresponded to the deformation behavior observed in the above-described pressure drop test at or near the pressure drop level of 2 kPa. In the case of the bottle in the second embodiment, even if the user applied more force by squeezing the bottle with the thumb and fingers, each panel recess 13*b* and its surroundings had only a very slight dent, and there was no problem for practical purposes. The bottle in the first embodiment could have been held even more firmly.

In contrast, the bottle in the comparative example showed large cave-in deformation into the reversed state, which started from each panel recess 13*b* and spread to its surroundings. The bottle was difficult to hold firmly, and there was inconvenience in that the deformation into a reversed state caused the contents to burst out of the bottle. Thus, like the pressure drop tests, the fingerhold strength tests, as conducted by placing the thumb and fingers into the recessed areas 13, also confirmed the action and effect of this invention having above-described construction concerning fingerhold strength.

This invention was described above with respect to preferred embodiments and the action and effect. However, it is to be understood that this invention should not be construed as limitative to the above-described embodiments. This invention can also be applied to the bottles made of materials other than the PET resins. Bottle of this invention is not limited to the square bottles having a rectangular cross-section, but this invention can be applied generally to square bottles having a body formed by flat panel walls. In the above-described embodiments, the dented side ribs have an almost square shape. However, various shapes in addition to the square shape can be adopted, giving consideration to the action and effect of the ribs in such shapes as transverse groove, vertical ridge, and esthetic appearance. If necessary, the recessed area can be spread to include a lower portion of the upper panel.

INDUSTRIAL APPLICABILITY

As described above, this invention provides a synthetic resin square bottle which is usable without anxiety, is excellent at firm hold, and has a high control effect on the cave-in deformation of panel walls into a reversed state. Wide applications are expected especially in the field of large-size square bottles.

The invention claimed is:

1. A synthetic resin square bottle comprising:

a body formed by multiple panel walls disposed in parallel to one another in a circumferential direction; and a waist portion made of a peripheral groove cut at a roughly middle height position of the body, the waist portion having a height range from a deepest portion of the groove to both of flat portions of the panel walls so as to divide each panel wall into an upper panel and a lower panel, wherein said bottle includes recessed areas for fingerhold use that are formed in at least a pair of opposing panel walls in certain areas ranging from the waist portion to an upper end portion of the lower panel and a pair of side ribs is formed on right and left sides of a lower portion of each recessed area in the lower panel of each panel wall, and each recessed area of the recessed areas is formed in such a manner that a continuous area including both insides of the waist portion and the lower panel are dented and, in order to improve stiffness of each recessed area, is reinforced by a circular-arc shaped underside rib disposed adjacent to a lowermost end of each recessed area along an outer edge of a vicinity portion of the lowermost end, and the pair of side ribs disposed at both side ends of the underside rib symmetrically about the lowermost end of each recessed area, wherein the underside rib is entirely oriented at a location between a rightmost side of a left one of the pair of side ribs and a leftmost side of a right one of the pair of side ribs, and at least a portion of the underside rib is disposed at a vertical position that overlaps a vertical position of the pair of side ribs.

2. The synthetic resin square bottle according to claim 1 wherein the body comprises four panel walls and four corner walls that connect two adjacent panel walls by chamfering the corners and wherein the body has a cross-section in a rectangular shape.

3. The synthetic resin square bottle according toclaim 1 wherein the body comprises four panel walls and four corner walls that connect two adjacent panel walls by chamfering the corners and wherein the body has a cross-section in a rectangular shape.

4. The synthetic resin square bottle according to claim 1 wherein the lower panel surface is uninterrupted directly between the side ribs and the recessed area.

5. The synthetic resin square bottle according to claim 4 wherein the lower panel surface is interrupted directly between the side ribs by only the recessed area.

6. The synthetic resin square bottle according to claim 1 wherein the side ribs are disposed at a vertical position of the bottle that overlaps a vertical position of the recess.

7. The synthetic resin square bottle according to claim 1 wherein the lower panel surface is interrupted directly between the side ribs by only the recessed area and the underside rib.

8. The synthetic resin square bottle according to claim 1 wherein each of the underside ribs is formed directly beneath the corresponding recessed area disposed in the lower panel and between the pair of side ribs.

9. The synthetic resin square bottle according to claim 1 wherein the recessed area includes a waist recess portion and a panel recess portion, the panel recess portion being a semicircular portion disposed below the waist recess portion, and the panel recess portion being disposed between the rightmost side of the left one of the pair of side ribs and the leftmost side of the right one of the pair of side ribs, and at least a portion of the panel recess portion is disposed at a vertical position that overlaps the vertical position of the pair of side ribs.

* * * * *